US008739340B1

(12) United States Patent
Jagosh et al.

(10) Patent No.: US 8,739,340 B1
(45) Date of Patent: Jun. 3, 2014

(54) DRILL BIT DRIVER

(75) Inventors: Brian Jagosh, Litchfield, IL (US); Alice Jagosh, Litchfield, IL (US); Stu Berger, Scardsale, NY (US)

(73) Assignee: Brian Jagosh and Alice Jagosh, Litchfield, IL (US)

( * ) Notice: Subject to any disclaimer, the term of this patent is extended or adjusted under 35 U.S.C. 154(b) by 416 days.

(21) Appl. No.: 13/037,765

(22) Filed: Mar. 1, 2011

Related U.S. Application Data

(60) Provisional application No. 61/371,615, filed on Aug. 6, 2010.

(51) Int. Cl.
*B26B 11/00* (2006.01)

(52) U.S. Cl.
USPC ..... 7/158; 7/165; 7/168

(58) Field of Classification Search
USPC ..... 7/158, 165, 168
See application file for complete search history.

(56) References Cited

U.S. PATENT DOCUMENTS

| | | | | |
|---|---|---|---|---|
| D273,077 | S | 3/1984 | Bell | |
| 4,676,703 | A * | 6/1987 | Swanson | 408/239 R |
| 5,779,404 | A | 7/1998 | Jore | |
| 5,785,468 | A | 7/1998 | Peritz | |
| 6,499,168 | B1 | 12/2002 | Anderson | |
| 6,877,937 | B2 * | 4/2005 | Hsiao | 408/238 |
| 7,237,987 | B2 * | 7/2007 | Hernandez et al. | 408/239 R |
| 2004/0096286 | A1 | 5/2004 | Hsiao | |
| 2004/0111804 | A1 | 6/2004 | Fan-Chiang et al. | |

* cited by examiner

*Primary Examiner* — Lee D Wilson
*Assistant Examiner* — Shantese McDonald

(57) ABSTRACT

The present invention allows for convenient drilling and screwing. Using the present driver, one can insert the stem into the drill, turn the swivel arm on the pivot pin so that the drill bit is facing outwards, slide the collar up and over the opposite side of the swivel arm and covering the drill bit until it is force fit in. Drill the hole, slide the collar back, turn the swivel arm so that now the screw bit is facing outwards and repeat the steps above in order to force bit the collar and thereby prohibiting the swivel arm to spin. The swivel arm is also equipped with a screw tight mechanism in order to hole the screw bit or drill firmly in the swivel arm. This also allows a person to switch different size drill bits and screw bits.

2 Claims, 3 Drawing Sheets

TOP VIEW (SPINDLE RELEASED)

SIDE VIEW

TOP VIEW (SPINDLE LOCKED)

DRILL BIT DRIVER

BACKGROUND

When pre drilling a hole, especially in wood, in order to accommodate a screw, a person needs both a drill bit and screw bit. In order to do this, one needs to first insert a drill bit in the drill, drill the hole, remove the drill bit and then insert the screw bit and so on and so forth. With this invention one can insert the stem into the drill, turn the swivel arm on the pivot pin so that the drill bit is facing outwards, slide the collar up and over the opposite side of the swivel arm and covering the drill bit until it is force fit in. Drill the hole, slide the collar back, turn the swivel arm so that now the screw bit is facing outwards and repeat the steps above in order to force bit the collar and thereby prohibiting the swivel arm to spin. The swivel arm is also equipped with a screw tight mechanism in order to hole the screw bit or drill firmly in the swivel arm. This also allows a person to switch different size drill bits and screw bits.

DESCRIPTION OF PREFERRED EMBODIMENTS

Figure 1:
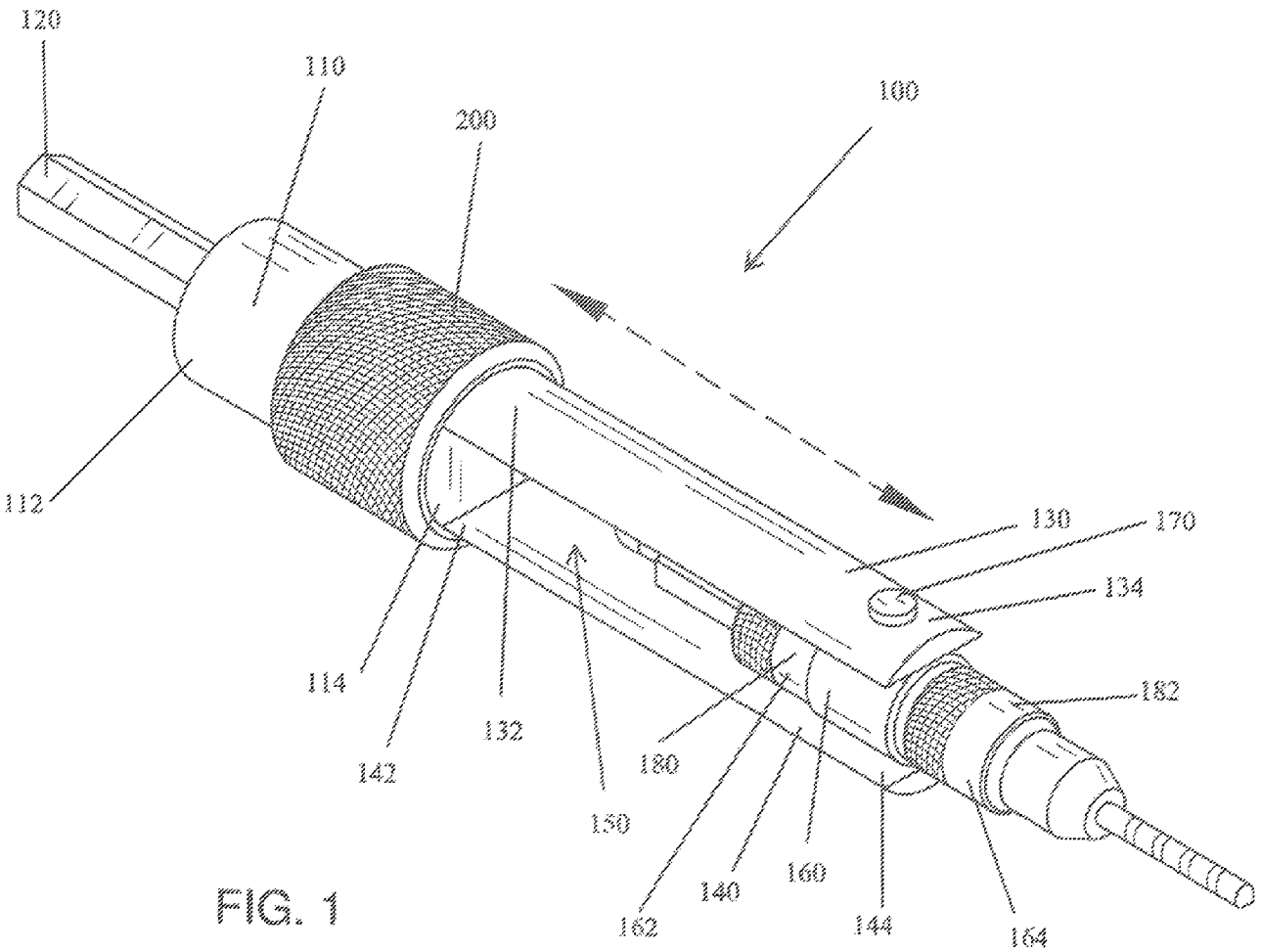
FIG. 1 is a top perspective view of the drill bit driver.
Figure 2:
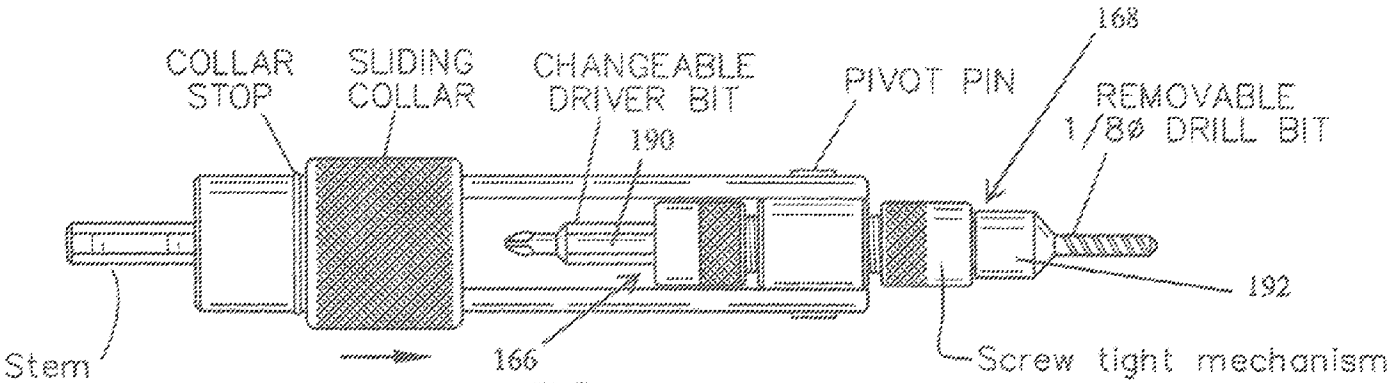
FIG. 2 is a side view of the drill bit driver.
Figure 3:
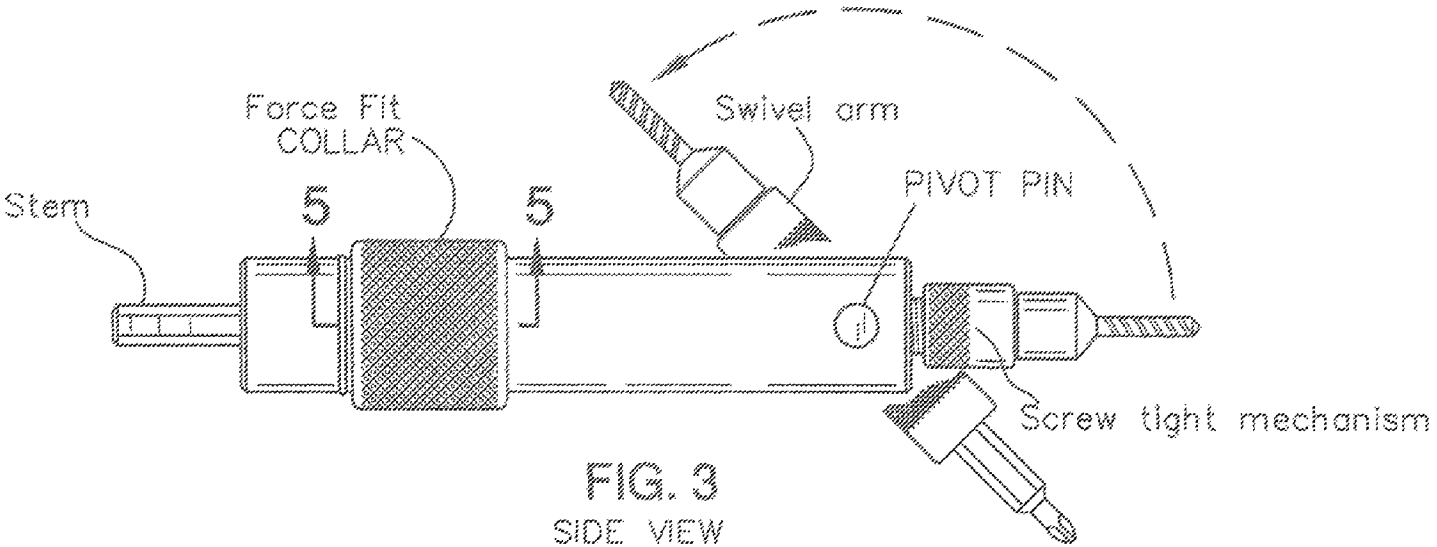
FIG. 3 is a side view of the drill bit driver.
Figure 4:
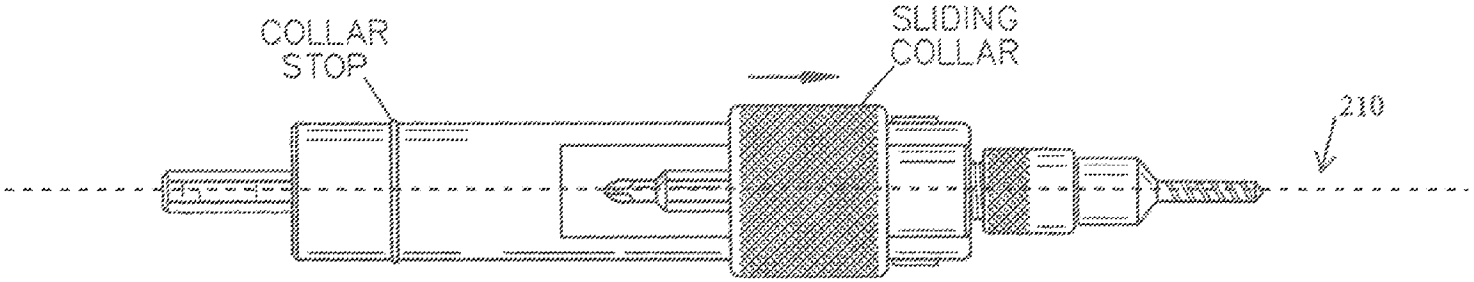
FIG. 4 is a side view of the drill bit driver showing the sliding collar.
Figure 5:
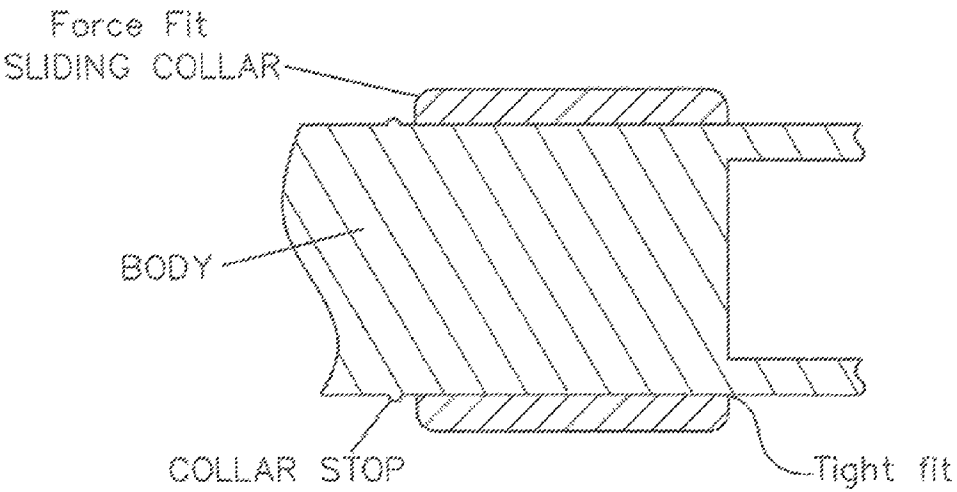
FIG. 5 is a side view cross section showing the force fit sliding collar and collar stop.

Referring now to FIG. 1-5, the present invention features a novel dual bit driver. In some embodiments, a dual bit driver 100 comprises a base 110 having a first end 112 and a second end 114. The first 112 and second end 114 are on opposite sides 116 of the base. The driver 100 further has a stem 120 attached to and extending away from the first end 112 of the base 110. In some embodiments, the driver has a first 130 and a second 140 arm, wherein the first arm 130 has a first proximal end 132 and a first distal end 134, and wherein the second arm 140 also has a second proximal end 142 and a second distal end 144. The first proximal end 132 of the first arm and the first proximal end 142 of the second arm attaches to the second end of the base 110, and the first 130 and second 140 arm extends away from the second end 114 of the base and are on opposite sides 116 of the base 110.

There is a gap 150 disposed between the first arm 130 and the second arm 140. In some embodiments, a swivel arm 160 is pivotably disposed at the distal ends of the first 134 and second 144 arms and within the gap 150 between the first 130 and second arm 140. The swivel arm 160 is pivotably attached to the first arm 130 via a first pivot pin 170. The swivel arm 160 has a first end 162 and a second end 164. In some embodiments, the first end 162 comprises a first bit slot 166 operably connected with a first screw tight mechanism 180 that can secure a first bit 190 to the first end 162 of the swivel 162. The second end 164 comprises a second bit 168 slot operably connected with a second screw tight mechanism 182 that can secure a second bit 192 to the second end 162 of the swivel.

The screw tight mechanism is a receptacle wherein a bit is placed into, then the screw tight mechanism is turned to tighten or secure the bit. The screw tight mechanism is well known to one of ordinary skill in the art.

In some embodiments, the driver 100 of the present invention comprises a sliding collar 200 disposed around the base 110 and can snuggly slide from the base towards the distal ends of the first 134 and second arms 144. When the sliding collar is not resting over the swivel arm 160, the swivel arm 160 can be spun about the pivot pin 170. When the sliding collar 200 is slid over the first 130 and second arms 140 and the sliding collar 200 rests over the swivel arm 160, the swivel arm 160 is locked in place becomes aligned with an axis 210 of the first 130 and second arm 140 and then only either the first 162 or second end 164 of the swivel arm projects frontward and away from the base 110.

In some embodiments, the bit driver 100 further comprises a collar stop 212 around the base 110. The collar stop 212 functions to prevent the sliding collar 200 from sliding off the base 110.

In some embodiments, the swivel arm 160 is pivotably attached to the second arm 140 via the first pivot pin 170.

Various modifications of the invention, in addition to those described herein, will be apparent to those skilled in the art from the foregoing description.

What is claimed is:

1. A dual bit driver 100 comprising:

(a) a base 110 having a first end 112 and a second end 114, the first 112 and second end 114 being on opposite sides 116 of the base;

(b) a stem 120 attached to and extending away from the first end 112 of the base 110;

(c) a first 130 and a second 140 arm, wherein the first arm 130 has a first proximal end 132 and a first distal end 134, wherein the second arm 140 has a second proximal end 142 and a second distal end 144, wherein the first proximal end 132 of the first arm and the first proximal end 142 of the second arm attaches to the second end of the base 110, wherein the first 130 and second 140 arm extends away from the second end 114 of the base and are on opposite sides 116 of the base 110;

(d) a gap 150 disposed between the first arm 130 and the second arm 140;

(e) a swivel arm 160 pivotably disposed at the distal ends of the first 134 and second 144 arms and within the gap 150 between the first 130 and second arm 140, the swivel arm 160 is pivotably attached to the first arm 130 via a first pivot pin 170, wherein the swivel arm 160 has a first end 162 and a second end 164, the first end 162 comprises a first bit slot 166 operably connected with a first screw tight mechanism 180 that can secure a first bit 190 to the first end 162 of the swivel 162, the second end 164 comprises a second bit 168 slot operably connected with a second screw tight mechanism 182 that can secure a second bit 192 to the second end 162 of the swivel;

(f) a sliding collar 200 disposed around the base 110 and can snuggly slide from the base towards the distal ends of the first 134 and second arms 144, wherein when the sliding collar is not resting over the swivel arm 160, the swivel arm 160 can be spun about the pivot pin 170, when the sliding collar 200 is slid over the first 130 and second arms 140 and the sliding collar 200 rests over the swivel arm 160, the swivel arm 160 is locked in place becomes aligned with an axis 210 of the first 130 and second arm 140 and then only either the first 162 or second end 164 of the swivel arm projects frontward and away from the base 110, wherein the sliding collar 200 freely moves from the base towards the distal ends of the first 134 and second arms 144 and back and is not biased in any one direction; and (g) a collar stop 212 around the base 110, the collar stop 212 functions to prevent the sliding collar 200 from sliding off the base 110.

2. The dual bit drive of claim 1 wherein the swivel arm 160 is pivotably attached to the second arm 140 via the first pivot pin 170.

* * * * *